United States Patent [19]

Parkinson

[11] Patent Number: 4,617,734

[45] Date of Patent: Oct. 21, 1986

[54] OYSTER OPENER

[76] Inventor: Brian Parkinson, 10 Euroka Street, West Wollongong, New South Wales, Australia, 2500

[21] Appl. No.: 618,980

[22] Filed: Jun. 11, 1984

[51] Int. Cl.[4] ..... A47J 13/00; A47J 43/26

[52] U.S. Cl. ..... 30/120.1

[58] Field of Search ..... 30/120.1, 120.2, 123.7, 30/346, 305; 7/113, 110, 106, 158, 169, 170; 81/3 R, 3.46 R

[56] References Cited

U.S. PATENT DOCUMENTS

D. 152,727 2/1949 Peterson ..... 7/158 X
1,720,575 7/1929 Smith ..... 30/120.2
2,082,982 6/1937 Schumacher ..... 7/113 X

FOREIGN PATENT DOCUMENTS 2451731 11/1980 France ..... 30/120.1

*Primary Examiner*—Douglas D. Watts
*Attorney, Agent, or Firm*—Townsend and Townsend

[57] ABSTRACT

A utensil for opening oyster or clam shells or the like comprising a jaw defined on at least one side by a blade which is shaped for insertion between and opening of the closed edges of said shells with the jaw being adapted to subsequently grip one of the opened shells and enable its removal by twisting of leverage action of the utensil.

2 Claims, 7 Drawing Figures

OYSTER OPENER

This invention relates to food utensils and more particularly provides an improved device for opening shelled seafood such as oysters or the like.

Existing tools for opening oyster shells typically comprise an elongated blunt nosed knife blade which is normally held in one hand by the user and forcibly inserted in through the mouth of the oyster which is held in the other hand. The blade is then subsequently used to pry apart the shells to expose the meat within. Such known devices however have a number of disadvantages. Unless handled with a high degree of expertise the insertion of the knife blade can easily mutilate the meat within which in the case of restaurants reduces customer appeal and in addition the shells are often broken or shattered during the process of prying them apart. Further the use of such unguarded blades commonly causes hand injury to inexperienced users.

It is therefore an object of this invention to ameliorate the aforementioned disadvantages and accordingly this invention discloses a utensil for opening oyster or clam shells or the like comprising a jaw defined on at least one side by a bladelike projection which is shaped for insertion between and opening of the closed edges of such shells with the jaw being adapted to subsequently grip one of the opened shells and enable its removal by a twisting or leverage action of the utensil.

Preferred embodiments of this invention will now be described with reference to the attached drawings in which.

Figure 1:
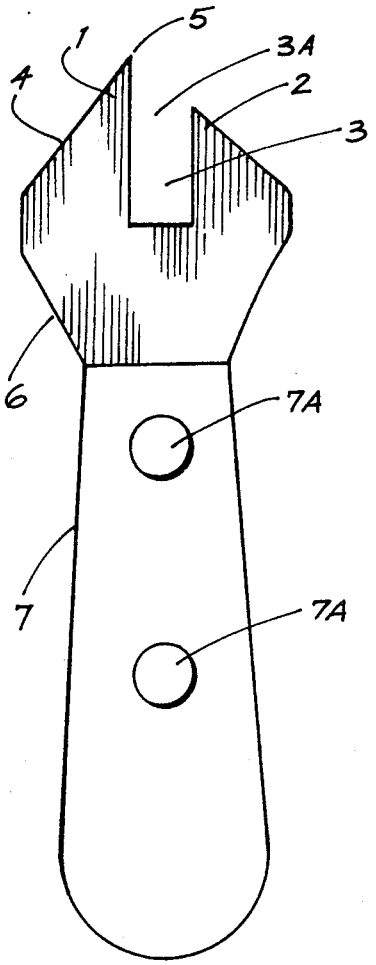
FIG. 1 is a schematic illustration of a first embodiment of a utensil for opening oyster shells according to this invention.

Referring first to FIG. 1 the utensil may comprise a pair of blades 1 and 2 punched or cut from one piece of sheet metal and defining therebetween a jaw 3. Although not readily apparent from the drawings it may be advantageous for the sides of the jaw to converge slightly in the direction of its open end 3A.

Preferably one of the blades 1 is specifically shaped for insertion between and opening of, a pair of closed oyster shells. Accordingly it is of greater length than blade 2 and a segment of the outer edge 4 is angled to provide a wedge shaped profile which terminates in a point 5. The edge 6 of the blade 1 leading back toward the handle 7 is also angled inwardly to provide a means of guarding against a user's hand inadvertently slipping onto the blades.

Figure 2:
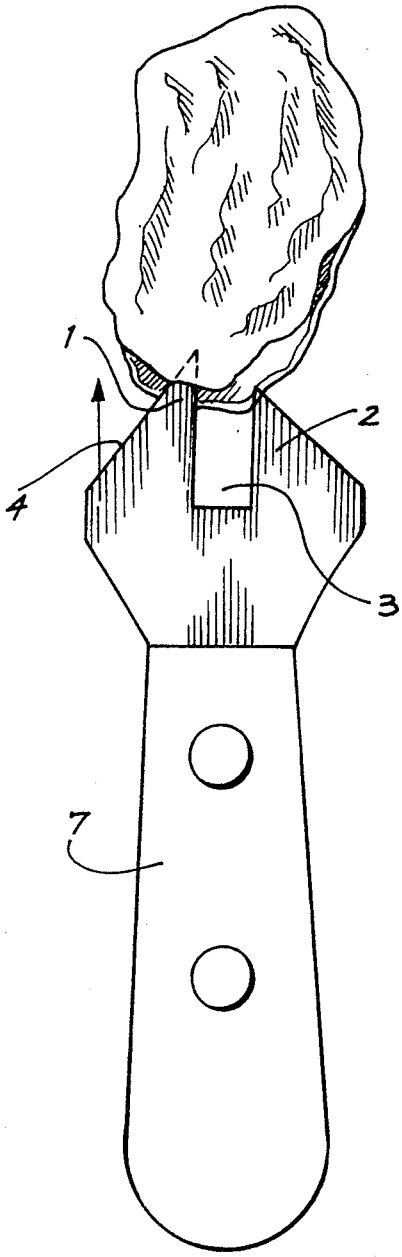
FIG. 2 shows the utensil of FIG. 1 being inserted between the shells of an oyster.

Preferably blade 2 is similarly profiled to correspond with blade 1 but is of slightly shorter length to enable a limited insertion of point 5 between the shells as shown in FIG. 2. The blade 2 therefore has the effect of engaging the outer surface of the oyster shells and so preventing any mutilation of the meat by the user inadvertently forcing the blade 1 too far in.

The blades may be affixed to any suitable design of handle 7 which with this embodiment is constructed of wood together with transverse rivets 7A. Clearly however a wide variety of other materials such as plastic could also be used.

Figure 4:
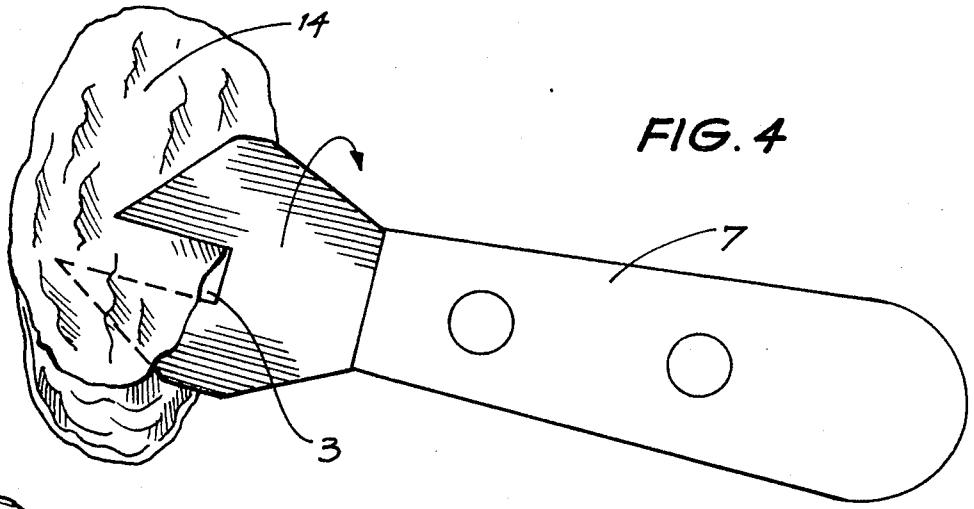
FIG. 4 shows the shells being subsequently separated.
Figure 3:
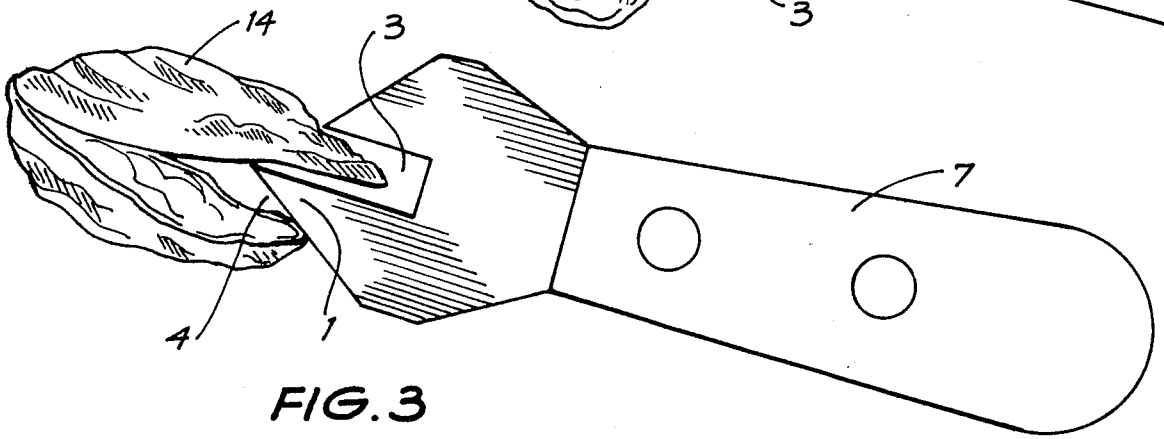
FIG. 3 shows the utensil of FIG. 1 opening the shells.

After insertion of blade 1 it can be turned through approximately 90° so that the shells may be pried open on the inclined edge 4 and the upper shell 14 simultaneously forced into the jaw 3. Further sideways manipulation of the device for example to the position shown in FIG. 4 enables the jaw 3 to lift and twist the upper shell clear of the lower shell of the oyster in one neat and efficient leverage action which preserves the integrity of the shells and leaves the meat virtually unblemished and untouched by the user's hands.

Figure 5:
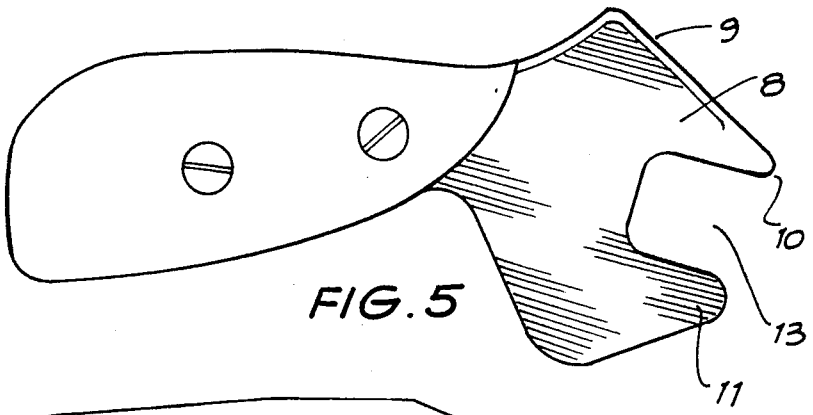
FIGS. 5 and 6 show top and side views of a second embodiment of this invention.
Figure 6:
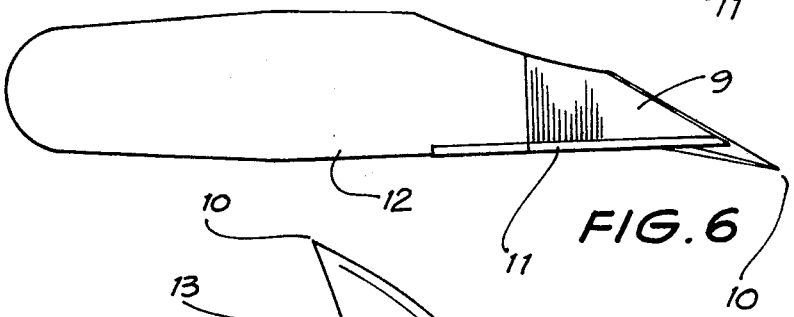

A second embodiment of a utensil according to this invention is shown in FIGS. 5 and 6. With this example the blade 8 is bent along the outer edge to form an upstanding flange 9 which is disposed at right angles to the blade 8 and slopes towards the point 10. As shown in FIG. 6 this point 10 is preferably slanted downwardly so that the blade 8 terminates a short distance below the level of the other blade 11 and handle 12 of the tool. It may also be advantageous to gently round the point 10 and internal perimeter of the jaw 13 to provide a more finished appearance for the blades and avoid unnecessary sharp edges. The blades 8 and 11 may be fabricated as one piece from stainless steel. The handle 12 is screwed to and/or moulded around the metal blades and also contoured to comfortably fit the palm of the user's right hand.

Figure 7:
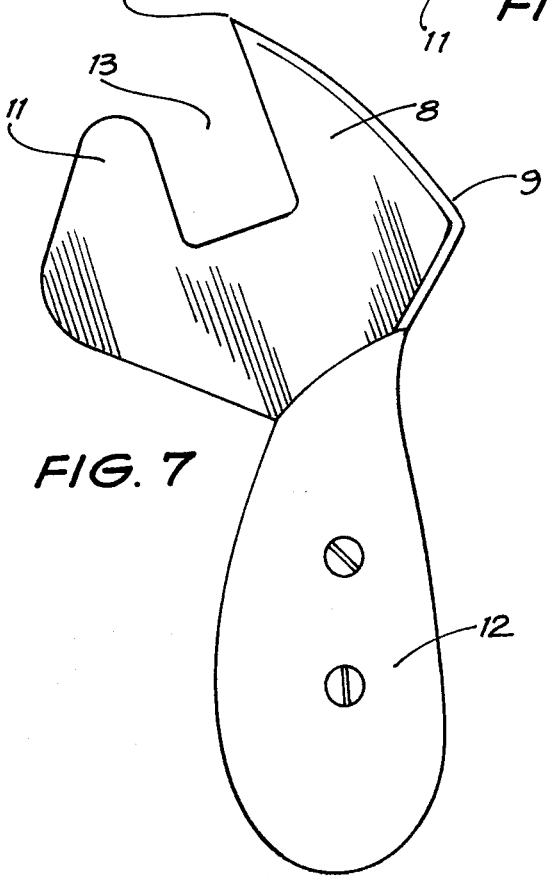
FIG. 7 shows a top view of a third embodiment of this invention.

A correspondingly shaped left handed model is shown schematically in FIG. 7 with the above-mentioned features identically numbered.

The preferred mode of operation is to grasp this utensil in either the right or left hand in accordance with the model being used so that the thumb abuts the outer face of the flange 9 and the forefinger rests against the upper surface of blade 11. The point 10 is then inserted (this may be facilitated by a gentle rocking motion) between a pair of closed oyster shells at the connecting ligament. As the inclined flange 9 and blade 8 are angled with respect to each other a wedging action results which opens the shells in a manner whereby the upper shell rides up on the inclined flange 9 and is forced into the jaw 12. Further twisting of the utensil through approximately 90° neatly severs the ligament and enables the jaw 12 to subsequently lift the upper shell clear of the meat within.

It will thus be appreciated that this invention at least in the form of the particular embodiments described provides an efficient, safe, and low cost tool for opening oysters or similar seafood which requires little expertise or manual dexterity. Clearly however the particular examples disclosed are only the presently preferred forms of this invention and a wide variety of modifications may be made. For example the particular shape, configuration, and dimensions of the blades and handle may be varied according to application and/or design preference as could the shape and size of the jaw. Also while it is preferred that the blades be constructed of stainless steel the invention expressly extends to the use of other suitable materials.

The claims defining the invention are as follows:

1. A utensil for opening oyster or clam shells or the like comprising a jaw defined by first and second bladelike projections.

said first projection being of greater length than said second projection for insertion between the closed edges of said shells, and further adapted to subsequently grip one of the opened shells and enable its removal by a twisting or leveraged action of the utensil; the outer edge of said first projection being angled to provide a wedge-shaped profile slanted downwardly to terminate in a point a short distance below the level of said second projection; said outer edge further containing an upstanding flange disposed at right angles thereto and sloping toward said point;

said second projection being adapted to engage the outer surface of said shells to thereby prevent the excessive penetration of said first projection and avoid mutilation of the meat within said shells;

the sides of said jaw converging slightly toward the open end thereof; said jaw being secured to a handle contoured to fit a user's hand with the user's thumb abutting the outer face of said flange and the user's forefinger resting against the upper surface of said second projection; the outer edges of said first and second projections leading back towards said handle being angled inwardly to provide a means of guarding against the user's hand inadvertently slipping onto the surfaces of said projections; and wherein said point and the internal perimeter of said jaw are slightly rounded to provide a more finished appearance to said first and second projections and to avoid any unnecessary sharp edges.

2. The utensil as claimed in claim 1 wherein said second blade-like projection is adapted to engage the outer surface of said shells to thereby prevent the excessive penetration of said first blade-like projection and avoid mutilation of the meat within the shells.

* * * * *